US007097798B2

(12) United States Patent
Ishii et al.

(10) Patent No.: US 7,097,798 B2
(45) Date of Patent: Aug. 29, 2006

(54) EQUIPMENT AND METHOD FOR MANUFACTURING HONEYCOMB STRUCTURAL BODY

(75) Inventors: Takeyuki Ishii, Nagoya (JP); Yuji Asai, Chita (JP); Tsutomu Hirota, Gifu (JP)

(73) Assignee: NGK Insulators, Ltd., Nagoya (JP)

( * ) Notice: Subject to any disclaimer, the term of this patent is extended or adjusted under 35 U.S.C. 154(b) by 123 days.

(21) Appl. No.: 10/486,909

(22) PCT Filed: Apr. 11, 2003

(86) PCT No.: PCT/JP03/04625

§ 371 (c)(1),
(2), (4) Date: Feb. 17, 2004

(87) PCT Pub. No.: WO03/089208

PCT Pub. Date: Oct. 30, 2003

(65) Prior Publication Data

US 2004/0194427 A1 Oct. 7, 2004

(30) Foreign Application Priority Data

Apr. 19, 2002 (JP) ..... 2002-117392

(51) Int. Cl.
*B28B 7/14* (2006.01)

(52) U.S. Cl. ..... 264/150; 425/169; 425/140; 425/135; 425/164; 425/315; 83/862; 83/79

(58) Field of Classification Search ..... 83/862, 83/79; 264/30, 150; 425/113, 130, 169, 425/140, 135, 164, 315
See application file for complete search history.

(56) References Cited

U.S. PATENT DOCUMENTS 4,702,138 A * 10/1987 Hattori et al. ..... 83/785
4,935,179 A * 6/1990 Kato et al. ..... 264/40.1
6,063,323 A * 5/2000 Fuls et al. ..... 264/432
6,154,000 A * 11/2000 Rastegar et al. ..... 318/632
6,520,061 B1 * 2/2003 Fukuta et al. ..... 83/651.1
6,711,979 B1 * 3/2004 Miyakawa et al. ..... 83/862
6,742,424 B1 * 6/2004 Fukuta et al. ..... 83/13
6,814,562 B1 * 11/2004 Shibagaki et al. ..... 425/382 R
2004/0195719 A1 * 10/2004 Ishii et al. ..... 264/177.12

FOREIGN PATENT DOCUMENTS

| | | |
|---|---|---|
| JP | A 63-230304 | 9/1988 |
| JP | B2 64-6916 | 2/1989 |
| JP | A 2001-47419 | 2/2001 |
| WO | WO 01/07224 | 2/2001 |

* cited by examiner

OTHER PUBLICATIONS

Wikipedia Definition of a Load Cell.*

*Primary Examiner*—Robert Davis
*Assistant Examiner*—G. Nagesh Rao
(74) *Attorney, Agent, or Firm*—Oliff & Berridge, PLC

(57) ABSTRACT

An apparatus for molding a honeycomb structure provided with an extruder for the honeycomb structure capable of extruding a honeycomb structure in the gravity direction or an oblique direction at an angle of smaller than 30° with the gravity direction and at least one cradle, said apparatus being provided with a means of being able to place the honeycomb structure extending in length with progress of extrusion on the cradle with cell opening end face 9 of the honeycomb structure being pressure contacted with the cradle under a pressure smaller than the compressive strength at the end face and then to move the cradle at a speed capable of keeping the pressure contact state and in the same direction as the lengthwise direction of the honeycomb structure.

20 Claims, 8 Drawing Sheets

EQUIPMENT AND METHOD FOR MANUFACTURING HONEYCOMB STRUCTURAL BODY

TECHNICAL FIELD

The present invention relates to an apparatus for producing a honeycomb structure and a method for producing a honeycomb structure using the apparatus. More particularly, the present invention relates to an apparatus for producing a honeycomb structure which is suitable for molding a thin-wall or large-sized honeycomb structure and a method for producing a honeycomb structure using the apparatus.

BACKGROUND ART

As for ceramic honeycomb structures which are recently used as catalyst carriers for purification of exhaust gases and others, attempts have been earnestly made to reduce the heat capacity of cell walls supporting the catalysts by reducing the thickness of the cell walls for rapidly raising the catalyst temperature at the time of starting of engine to improve purification performance. Specifically, at present, a thickness of the cell walls of 0.1–0.2 mm is mainly employed, and even a thicknes of less than 0.1 mm is employed.

Furthermore, the attempt to thin the cell walls is also made for large-sized honeycomb structures, and at present, large-sized products of more than 150 mm in outer diameter which are thinned in walls are put to practical use.

On the other hand, conventional apparatuses for producing honeycomb structures and method for producing them are generally those according to which honeycomb structures extruded from an extruder are continuously extruded in a direction perpendicular to the gravity direction while placing them on a plurality of cradles having concave faces corresponding to the shape of the outer peripheral side face (JP-B-64-6916, etc.).

As an automatic cutting device suitable for the apparatuses for producing honeycomb structures and method for producing them by the continuous extrusion molding, there is disclosed an automatic cutting device having a cradle on which the honeycomb structures are placed, a carrying path for moving the cradle with the honeycomb structures placed thereon, a speed sensor for sensing the extrusion speed of the honeycomb structures, a cutting device carrying out the cutting of the honeycomb structures while moving in the moving direction of the honeycomb structures and at the same speed as the extrusion speed of the honeycomb structures which is sensed by the speed sensor (the same patent publications referred to as above).

However, since according to the conventional apparatuses and methods, the honeycomb structure is extruded in the direction perpendicular to the gravity direction, there is a problem that its own weight is apt to be applied in the thickness direction of cell wall which is structually small in strength. Therefore, in case a honeycomb structure which is considerably reduced in strength due to the reduction in wall thickness or a honeycomb structure in which its own weight is apt to be applied in the thickness direction of the cell wall due to increase in size is produced, there occurs distortion of outer wall such as rupture, or distortion of cell wall such as cell twisting or mesh creasing owing to its own weight, and these are severe causes to hinder reduction in thickness of walls and increase in size of the honeycomb structure.

As a result of intensive investigations conducted by the inventors in an attempt to solve the above problems, first, it has been found to employ the gravity direction or an oblique direction at an angle of smaller than 30° with the gravity direction (hereinafter referred to as "gravity direction, etc." as the extrusion direction of the extruding machine so as to apply the own weight of the honeycomb structure mainly in the lengthwise direction of the cell wall which has structurally the highest strength.

However, it has been found that according to the apparatuses having the above extrusion direction, there is a new problem that distortion is apt to occur in the extruded honeycobm structure due to the force in the diameter direction with extension in length of the extruded honeycomb structure, being different from the conventional apparatuses in which cradles are successively supplied to the outer peripheral side surface.

That is, when the extrusion direction is the gravity direction, etc., it has been found that the honeycomb structure extruded becomes difficult to maintain its inherent attitude even by a very small force in the diameter direction with extension of the length, and there occurs distortion of outer wall due to bend or rupture of the honeycomb structure or distortion of cell walls such as cell twisting at the position of opening of die at which forces in the diameter direction are apt to be concentrated owing to the factors such as cutting stress caused by cutting with a small-gage wire, vibration of machine and others.

DISCLOSURE OF INVENTION

The present invention has been made in view of the above problems, and the object of the present invention is to provide an apparatus and method for producing a honeycomb structure by which a thin-walled or large-sized honeycomb structure can be produced with causing no distortion of outer shape and cell walls.

As a result of further investigations conducted by the inventors, it has been found that the above problems can be solved by molding a honeycomb structure while receiving the extruded honeycomb structure at its cell opening end face in such a state as being pressure contacted under a pressure smaller than compressive strength at the cell opening end face, and by cutting the honeycomb structure in this pressure contacting state by a cutting device. Thus, the present invention has been accomplished.

That is, the present invention relates to an apparatus for producing a honeycomb structure which has an extruder capable of extruding a honeycomb structure in the gravity direction and at least one cradle, and which is provided with a means capable of placing a honeycomb structure extending in length with progress of extrusion on the cradle with cell opening end face of the honeycomb structure being pressure contacted with the cradle under a pressure smaller than the compressive strength at the end face and then moving the cradle at a speed capable of keeping the pressure contact state and in the same direction as the lengthwise direction of the honeycomb structure.

It is preferred that the above apparatus is further provided with a cutting device, and this cutting device is provided with a means capable of cutting the honeycomb structure in the state of being pressure contacted with the cradle. Furthermore, it is preferred that the apparatus is provided with two or more cradles and a cutting device, and the honeycomb structure is placed on one of the cradle with the cell opening end face of the honeycomb structure being pressure contacted with the cradle under a pressure smaller than the compressive strength at the end face, and then this cradle is moved in the same direction as the lengthwise direction of the honeycomb structure and at a speed capable of keeping the pressure contact state; the honeycomb structure in the pressure contacting state is cut by the cutting device; this cradle is moved after completion of the cutting to a position at which the honeycomb structure is transferred; after transferring of the honeycomb structure, the cradle is allowed to be on standby at a given position; and in parallel with the motion of this cradle, another cradle is moved to the cell opening end face of the honeycomb structure freshly extruded after completion of the cutting; the same operations as of the former cradle are repeated.

The cutting device is preferably provided with a means of cutting the honeycomb structure by moving also in horizontal direction while moving in the same direction as the lengthwise direction of the honeycomb structure and at the same speed as the extrusion speed in the lengthwise direction. Furthermore, the cutting device in the present invention preferably comprises at least two arm members, a rotating member fitted at the tip of each of the arm members, a cutting small-gage wire stretched between the rotating members, and a driving part to which both ends of the cutting small-gage wire are connected, and said cutting small-gage wire is moved in the stretching direction by the working of the driving part.

Furthermore, in the present invention, the apparatus is preferably further provided with a speed sensor which senses the extrusion speed of the honeycomb structure in the lengthwise direction, and the speed sensor may be one which senses the extrusion speed in lengthwise direction in non-contact state with the honeycomb structure.

Furthermore, the apparatus of the present invention may further provided with a load sensor sensing the load applied to the cradle. For example, the apparatus may be such one in which the cradle is provided with a main body connected to the cradle moving part, a placing part provided on the main body in movable state, and an elastic body which produces a displacement by a load applied to the placing part, and is provided with a load sensor sensing the load applied to the placing part by the displacement of the elastic body. Alternatively, the apparatus may be such one in which the cradle has a main body connected to the cradle moving part and a placing part provided on the main body in movable state, and is provided with a load sensor sensing the load applied to the placing part by the bending displacement of a piezoelectric body.

Furthermore, the apparatus for producing a honeycomb structure may be one which is provided with a means of sensing by the load sensor the change of load applied to the cradle when the extended honeycomb structure presses the cradle and starting the movement of the cradle and/or the cutting device based on the information sensed by the load sensor in the lengthwise direction of the honeycomb structure.

The apparatus for producing a honeycomb structure may be one which is provided with a means according to which the extrusion speed of the honeycomb structure in the lengthwise direction is sensed by the speed sensor and, based on the sensed information, the cradle after starting the movement is moved at nearly the same speed as the extrusion speed of the honeycomb structure in the lengthwise direction.

The apparatus for producing a honeycomb structure may be one which is provided with a means according to which the change of load applied to the cradle which is caused due to the deviation between the moving speed of the cradle after starting of the movement and the moving speed of the honeycomb structure in the lengthwise direction is sensed by the load sensor, and, based on the sensed information, the cradle is adjusted so that the change of the load is within the desired range.

The apparatus for producing a honeycomb structure may be one which is provided with a means according to which the extrusion speed of the honeycomb structure in the lengthwise direction is sensed by the speed sensor and, based on the sensed information, the cutting device is moved also in the horizontal direction while moving in the same direction as the lengthwise direction of the honeycomb structure and at the same speed as the extrusion speed in the lengthwise direction, thereby to cut the honeycomb structure.

The apparatus for producing a honeycomb structure may be one which is provided with a means according to which the change of load applied to the cradle which is caused at the time of completion of cutting of the honeycomb structure, and, based on the sensed information, movement of the cradle to the position at which the honeycomb structure is transferred and/or movement of the cradle to the cell opening end face of the freshly extruded honeycomb structure are started.

The apparatus for producing a honeycomb structure comprising the above construction may be one in which the extruder is provided with a means capable of extruding the honeycomb structure in the direction which is oblique at an angle of smaller than 30° with the gravity direction.

Furthermore, according to the present invention, there is provided a method for producing a honeycomb structure, characterized by extruding a material mainly composed of ceramics by the extruder in the gravity direction or an oblique direction at an angle of smaller than 30° with the gravity direction to form a honeycomb structure having a plurality of cells opening at an end face, molding the extruded honeycomb structure with the cell opening end face of the honeycomb structure being pressure contacted with the cradle under a pressure smaller than the compressive strength at the end face, and cutting the honeycomb structure in the state of being pressure contacted with the cradle. In the above method, it is preferred to carry out the cutting of the honeycomb structure while moving the cutting device in the same direction as the lengthwise direction of the honeycomb structure and at the same speed as the extrusion speed in the lengthwise direction.

DESCRIPTION OF REFERENCE NUMERALS

Figures 1A, 1B, 1C:
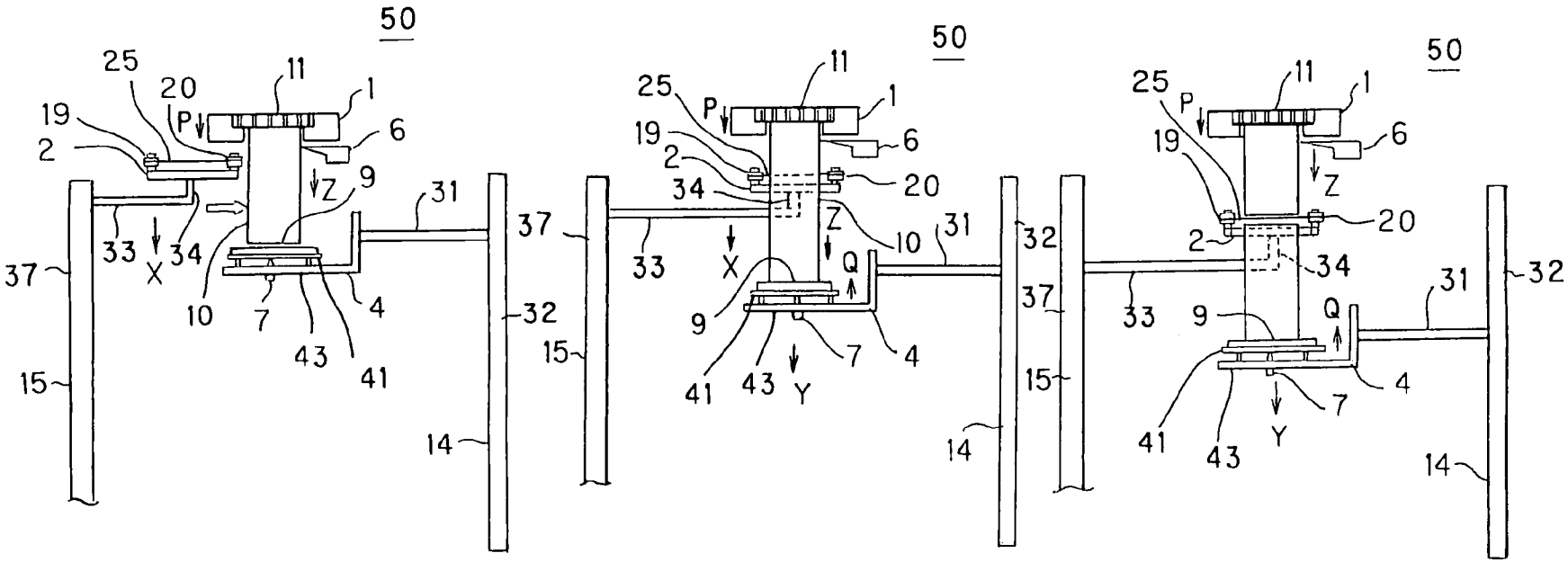
FIG. 1(*a*)-(*c*) show a flow sheet which illustrates a series of the operations in sequence of steps on one embodiment of the present invention.

The following reference numerals used in the accompanying drawings indicate the following components of the apparatus. 1 - - - Extruder, 2 - - - Cutting device, 4,5 - - - cradles, 6 - - - Speed sensor, 7 - - - Load sensor, 8 - - - Outer peripheral side surface, 9 - - - Cell opening end face, 10 - - - Honeycomb structure, 11 - - - Die, 11*a* - - - Substrate, 11*b* - - - Slit, 11*c* - - - Introducing hole for puddle, 13 - - - Extruding mechanism for puddle, 14 - - - cradle moving part, 15 - - - Cutting device moving part, 16 - - - Carrying machine, 19, 20 - - - Arm member, 21, 22 - - - Rotating member, 24 - - - Driving part, 25 - - - Small-gage wire for cutting, 31 - - - Arm part, 32 - - - Lifting part, 33 - - - Second arm part, 34 - - - First arm part, 35 - - - Auxiliary part, 37 - - - Lifting part, 39 - - - Piezoelectric body, 40 - - - Elastic body, 41 - - - Placing part, 42 - - - Spring, 43 - - - Main body, 44 - - - Sensing part, 45 - - - Air cylinder, 46 - - - Air cushion, 47 - - - Load cell, 50 - - - Apparatus for producing (honeycomb structure)

BEST MODE FOR CARRYING OUT THE INVENTION

First, a series of operations of the apparatus for producing the honeycomb structure of the present invention will be explained in sequence of the steps referring to FIG. 1(*a*)-(*c*). FIG. 1(*a*)-(*c*) show one embodiment of the apparatus for producing a honeycomb structure according to the present invention, and more specifically the apparatus for producing a honeycomb structure by extruding the honeycomb structure in the gravity direction, but the basic operation is the same in the apparatus for producing a honeycomb structure by extruding in a direction oblique at an angle of smaller than 30° with the gravity direction.

As shown in FIG. 1(*a*)-(*c*), in the production apparatus 50 of the present invention, an extruder 1 is provided so that an extrusion direction P is the gravity direction, namely, the direction of application of its own weight is the lengthwise direction of cell walls in which the highest strength against the own weight is obtained, thereby to diminish the distortion of outer wall or cell walls (even in the case of an oblique direction at an angle of smaller than 30° with the gravity direction, the direction of application of the own weight is mainly the lengthwise direction of the cell wall). However, when the honeycomb structure 10 extruded from the extruder 1 extends in length, the honeycomb structure is apt to become unstable in its attitude against the force in the diameter direction.

Therefore, as shown in FIG. 1(*a*) (*b*), in the production apparatus 50 of the present invention, the cradle 4 is moved by a cradle moving part 14 to just below the cell opening end face 9 of the honeycomb structure 10 extruded from the extruder 1, and the honeycomb structure 10 is placed on the cradle 4 while allowing the cell opening end face 9 to pressure-contact with the cradle 4 under a pressure Q which is smaller than compressive strength at the cell opening end face, whereby the inherent attitude of the honeycomb structure can also be stably maintained against the force in the diameter direction. Starting of the movement of the cradle 4 to just below the cell opening end face 9 can be carried out, for example, by providing a sensor 7 sensing the load onto the cradle 4, sensing the change of the load onto the cradle 4 caused at the time of completion of cutting of the honeycomb structure 10, and starting the movement based on the thus sensed information.

As shown in FIG. 1(*b*) (*c*), the cradle 4 having the honeycomb structure 10 placed thereon is moved in the same direction Y as the lengthwise direction Z of the honeycomb structure 10 and at nearly the same speed as the extrusion speed in the lengthwise direction by the cradle moving part 14, whereby the honeycomb structure 10 which becomes longer with lapse of time by continuous extrusion from the extruder 1 is in such a state as the cell opening end face 9 being pressure contacted with the cradle 4 under a specific pressure Q from the time of the honeycomb structure being short in size up to the time of the cutting being completed, and the attitude of the honeycomb structure becomes always stable. Starting of the movement of the cradle 4 in lengthwise direction Z can be performed, for example, by sensing the change of the load caused when the extended honeycomb structure presses the cradle 4 which is on standby just below the cell opening end face and carrying out the starting based on the sensed information. Similarly, control of the moving speed of the cradle 4 after starting of movement can be performed, for example, by driving the cradle moving part 14 based on the extrusion speed in lengthwise direction of the honeycomb structure 10 which is sensed by the speed sensor 6.

Usually, when the honeycomb structure 10 reaches the desired length, the honeycomb structure 10 is cut in the diameter direction, but in the apparatus 50 of the present invention, the cutting device 2 need not necessarily be provided, and the honeycomb structure 10 kept in the state of stable attitude may be manually cut. However, as shown in FIG. 1(*a*)-(*c*), the apparatus is preferably one in which the cutting device 2 and the cutting device moving part 15 which allows the cutting device 2 to start a desired movement are provided and the honeycomb structure 10 is cut in the state of stable attitude.

Figure 2:
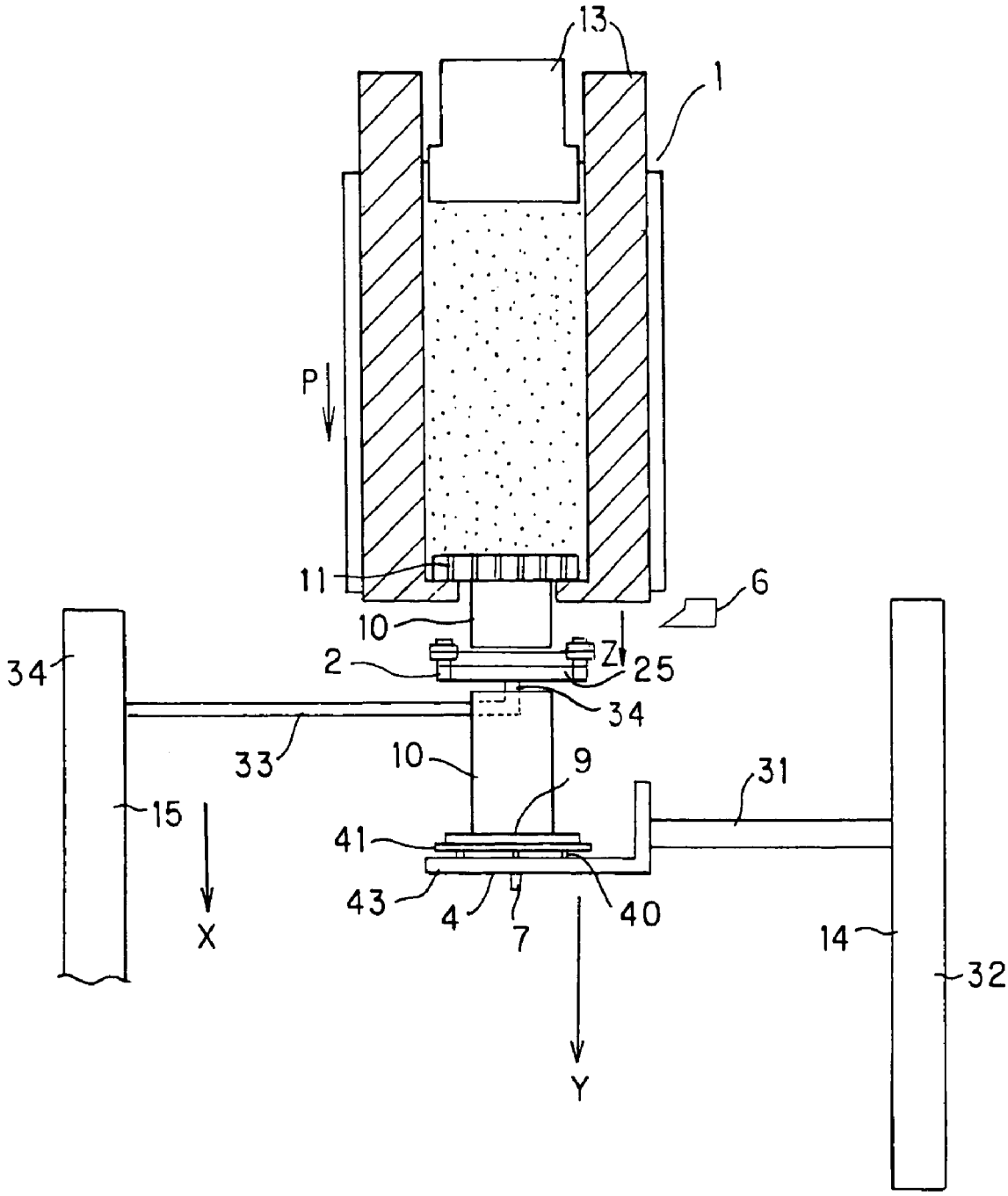
FIG. 2 is a general view which schematically shows another embodiment of the present invention.
Figure 3:
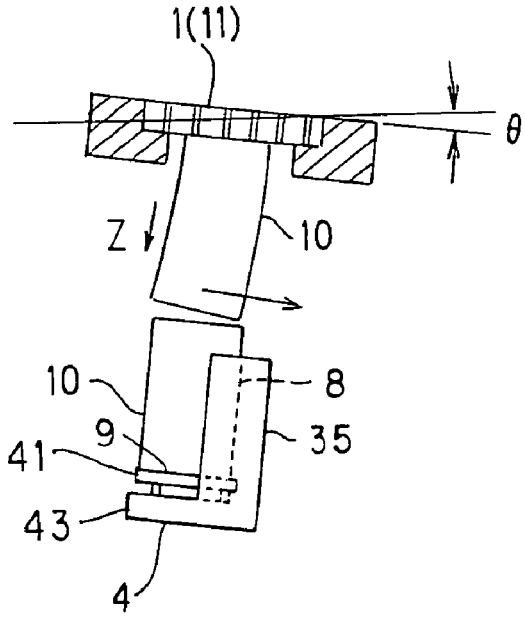
FIG. 3 is a schematic view which shows one embodiment of the apparatus of the present invention in which the extrusion direction is oblique and an auxiliary part is provided at the cradle.

The embodiment of the present invention will be further explained on each constituent referring to the drawings. FIG. 2 is a diagrammatic side view which schematically shows the whole of the apparatus for producing a honeycomb structure in which the honeycomb structure is extruded in the gravity direction as one embodiment of the present invention. FIG. 3 is a diagrammatic side view which schematically shows a part of the apparatus for producing a honeycomb structure in which the honeycomb structure is extruded in a direction oblique at an angle of 30° with the gravity direction as one embodiment of the present invention.

As shown in FIG. 2 or FIG. 3, the extruder 1 in the present invention is provided so that the extrusion direction P is a gravity direction or an oblique direction at an angle of smaller than 30° with the gravity direction. Thus, in the molded honeycomb structure 10, its own weight is mainly applied in the lengthwise direction of cell walls which have structurally the highest strength, and hence even when a very thin-wall honeycomb structure or a large-sized honeycomb structure having an outer diameter of not less than 150 mm is produced, this can be molded without causing distortion in outer wall or cell walls.

In the present invention, the extrusion direction P can be selected depending on the purpose of use and is preferably the gravity direction in which the own weight is applied only in the lengthwise direction of cell walls as shown in FIG. 2. However, as shown in FIG. 3, it is also preferred that the extrusion direction P is an oblique direction, from the viewpoints that the honeycomb structure 10 can be supported at its cell opening end face 8 and the outer peripheral side surface 9 and the attitude of the honeycomb structure 10 can be in more stable state and bend of the honeycomb structure 10 caused by the characteristics of the extruder 1 can be corrected by the gravity. In this case, the extrusion direction P may be tilted so that the gravity direction is opposite to the bending direction of the honeycomb structure 10, and the tilting angle may be a proper angle depending on the degree of bending. The tilting angle is preferably smaller than 30° with the gravity direction in order that when the honeycomb structure is placed, its own weight is applied mainly in the lengthwise direction of the cell walls.

As shown in FIG. 2, as the extruder 1 in the present invention, there can be mentioned one which has at least a die 11 and an extruding mechanism 13 for puddle.

Figure 5B:
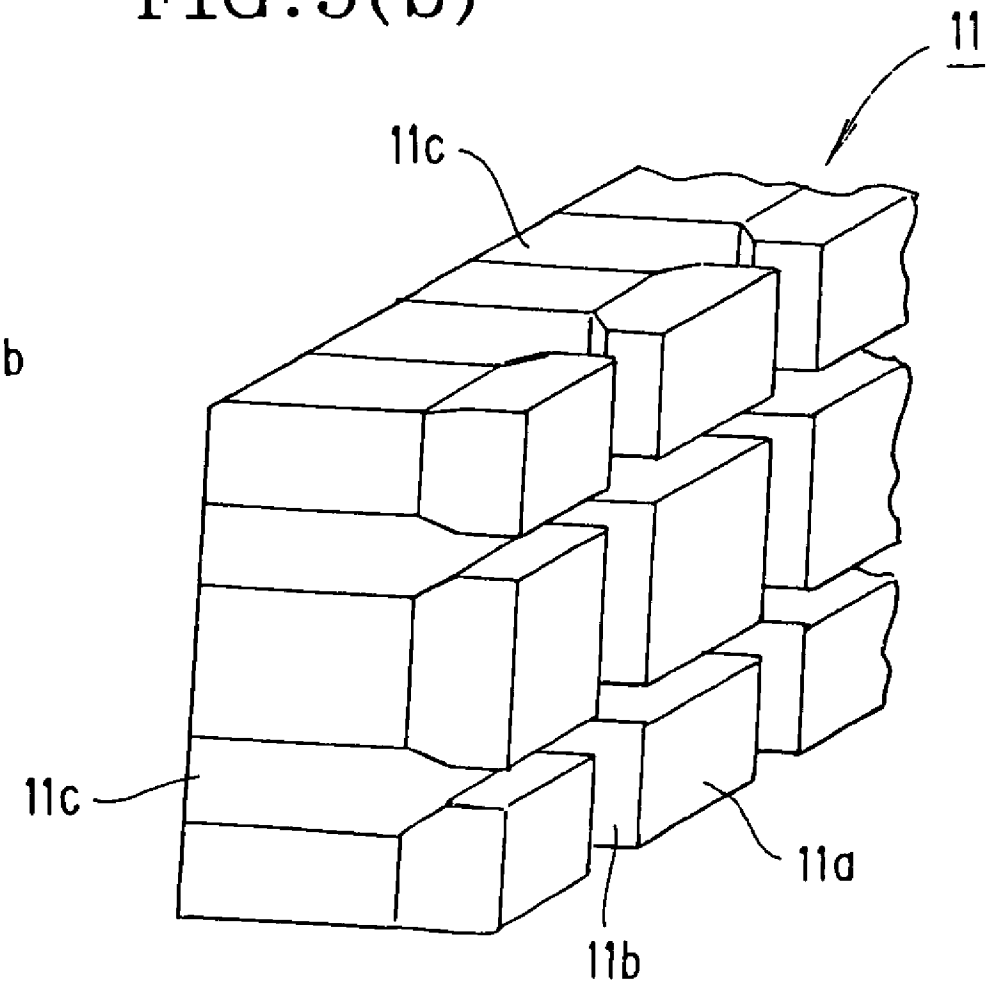
FIG. 5(*a*) and (*b*) are both top views which show one example of a die used in the extruder in the present invention, and FIG. 5(*b*) is a partial oblique view which shows a part of FIG. 5(*a*).
Figure 5A:
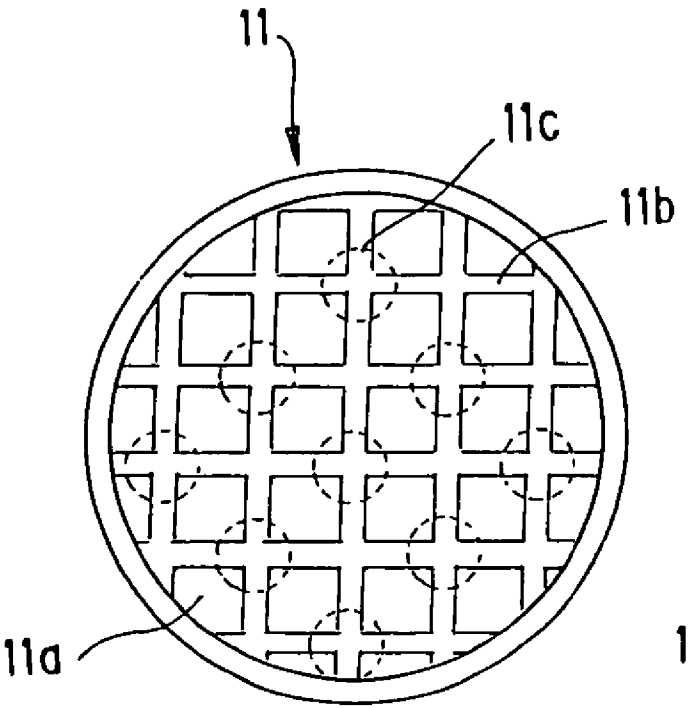

As shown in FIGS. 5(*a*) (*b*), as the die 11, mention may be made of one which has slits 11*b* such as lattice slits on the extrusion side of a substrate 11*a* such as disc-shaped substrate and introduction holes 11*c* for puddle on the side of the substrate 11*a* opposite to the extrusion side, the introduction holes 11*c* for puddle communicating with the slits 11*b* at the positions where the slits 11*b* cross each other inside the substrate 11*a*. The thickness of the cell walls of the honeycomb structure can be adjusted by the width of the slits 11*b*, and, as mentioned above, at present, a honeycomb structure having cell walls of 0.1 mm or less in thickness can be produced.

Furthermore, as shown in FIG. 2, the extruding mechanism 13 for puddle is, for example, one which has a ram cylinder structure, but preferred is one in which a plurality of screws (not shown) are provided to continuously carry out kneading of raw material and extrusion of the resulting puddle.

Next, as shown in FIG. 1(*a*)-(*c*), the cradle 4 in the present invention holds the honeycomb structure 10 extruded from the extruder 1 at its cell opening end face 9 in such a state as the cell opening end face being pressure contacted with the cradle under a pressure Q which is smaller than the compressive strength at the cell opening end face of the honeycomb structure 10 and moves keeping this pressure contacting state in the same direction as the lengthwise direction Z of the honeycomb structure 10.

Thus, the honeycomb structure 10 extruded in the gravity direction, etc. can stably maintain the inherent attitude against the force applied in diameter direction, and a honeycomb structure 10 having no distortion of outer wall due to bending and of cell wall due to cell twisting can be produced.

Furthermore, since the honeycomb structure 10 is placed with the cell opening end face 9 contacting with the cradle, the shape of the cradle 4 need not correspond to the outer shape of the honeycomb structure 10 extruded, and the apparatus 50 can be simplified. Furthermore, basically the position of cutting is not limited due to the presence of the cradle 4, and when the apparatus carries out continuous extrusion, length of the honeycomb structure 10 can be flexibly changed while carrying out continuous operation.

Here, the term "compressive strength at cell opening end face" in this specification means a critical pressure under which the honeycomb structure breaks when the cell opening end face of the honeycomb structure is pressed.

In the present invention, the range of pressure Q applied to the cell opening end face 9 by the cradle 4 is preferably set leaving a margin over the critical value for making the attitude of the honeycomb structure 10 more stable and for dealing with the abrupt change of the extrusion speed in the lengthwise direction of the honeycomb structure 10.

Specifically, the pressure Q is preferably 10–80%, more preferably 40–60%, most preferably 50% of the compressive strength at the cell opening end face.

Moreover, as mentioned hereinafter, in the apparatus 50 in which the completion of cutting is sensed by the change of load applied to the cradle 4 upon completion of cutting and the cradle 4 starts the desired movement after completion of cutting, the pressure Q applied to the cell opening end face 9 by the cradle 4 is preferably lower than the pressure applied to the cradle 4 by the weight of the honeycomb structure 10 after cutting, and more preferably 80% or lower and especially preferably 50% or lower of the pressure applied to the cradle 4 by the weight of the honeycomb structure 10 after cutting.

In order to maintain the pressure contacting state, the cradle 4 is moved to just below the cell opening end face 9 of the honeycomb structure 10 by the cradle moving part 14 and is rested there for a certain short period, or the cradle 4 is moved to the direction of the end face 9 by a specific short distance and when the desired pressure contacting state is attained, the cradle 4 is moved in the lengthwise direction Z of the honeycomb structure 10 at nearly the same speed as the extrusion speed in the lengthwise direction.

Figure 4:
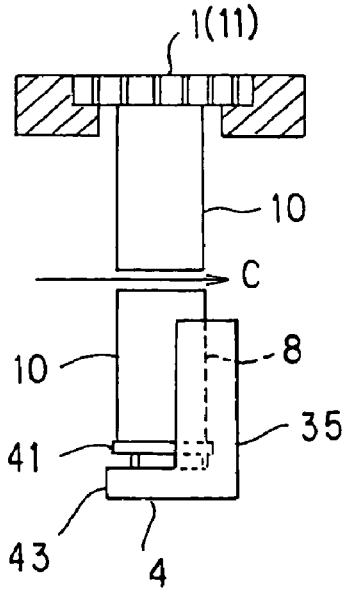
FIG. 4 is a schematic view which shows one embodiment of the apparatus of the present invention in which the extrusion direction is the gravity direction and an auxiliary part is provided at the cradle.

Next, as shown in FIG. 4, in addition to the placing part 41 provided corresponding to the cell opening end face 9 of the honeycomb structure 10, an auxiliary part 35 having a supporting face corresponding to a part of the outer peripheral side surface 8 of the honeycomb structure 10 may be provided at the main body 43 or the placing part 41 (the drawing shows an example of providing it at the main body 43) at the position opposing the cutting stress (the cutting direction is shown by C in the drawing), whereby the cradle 4 holds the honeycomb structure 10 at its cell opening end face 9 and its outer peripheral side surface 8.

When such cradle 4 is used, distortion of the honeycomb structure 10 at the time of cutting can be highly inhibited, and the effect is especially high in the case of producing honeycomb structure 10 having especially a high open frontal area or a large length/diameter ratio.

Furthermore, as shown in FIG. 3, when the extrusion direction is a direction oblique at an angle of smaller than 30° with the gravity direction, it is also preferred that in addition to the placing part 41, an auxiliary part 35 having a supporting face corresponding to at least a part of the outer peripheral side surface 8 to which own weight is applied may be provided at the main body 43 or the placing part 41 (the drawing shows an example of providing it at the main body 43), whereby the cradle 4 holds the honeycomb structure 10 at its cell opening end face 9 and its outer peripheral side surface 8. Thus, since a part of the own weight of the honeycomb structure 10 can also be supported at the outer peripheral side surface 8 during extrusion molding, the honeycomb structure 10 is placed at more stable state and failure of molding can be highly inhibited.

The supporting surface of the auxiliary part 35 may not necessarily completely conform to the configuration of the outer peripheral side surface 8 of the honeycomb structure 10, but it is a matter of course that the supporting surface preferably completely conforms to the configuration of the outer peripheral side surface 8.

In the present invention, when the honeycomb structure 10 is placed on the cradle 4 with its cell opening end face 9 and at least a part of the outer peripheral side surface 8 being contacted with the cradle 4 provided with the auxiliary part 35, it is preferred to place the honeycomb structure 10 on the cradle 4 with pressure contacting the cell opening end face 9 with the cradle 4 under a pressure at least two times the pressure applied to the outer peripheral side face 8 and lower than the compressive strength at the cell opening end face of the honeycomb structure 10.

If the honeycomb structure 10 is placed on the cradle 2 with pressure contacting the cell opening end face 9 with the cradle 2 under a pressure lower than two times the pressure applied to the outer peripheral side face 8, the pressure applied to the honeycomb structure 10 in the diameter direction due to its own weight increases to cause distortion of cell walls or the like of the honeycomb structure 10. On the other hand, if the honeycomb structure 10 is placed on the cradle 2 with pressure contacting the cell opening end face 9 with the cradle under a pressure higher than the compressive strength at the cell opening end face of the honeycomb structure 10, the honeycomb structure 10 is broken.

In the present invention, in order to make it possible to produce honeycomb structure 10 of very thin cell wall or a large-sized honeycomb structure 10 without causing distortion of cell walls or the like and in order to make it possible to cope with an abrupt change of the extrusion speed in the lengthwise direction of the honeycomb structure 10, the pressure Q applied to the cell opening end face by the cradle 4 is preferably at least two times the pressure applied to the outer peripheral side face 8 and not higher than 80% of the strength of the honeycomb structure in the extrusion direction, and more preferably at least three times the pressure applied to the outer peripheral side face 8 and not higher than 80% of the strength of the honeycomb structure in the extrusion direction.

Here, the term "pressure applied to outer peripheral side surface" means a pressure applied to the outer peripheral side surface 8 contacting with the auxiliary part 35 by the gravity in the state of the honeycomb structure 10 being placed on the cradle 4 with applying no pressure to the cell opening end face 9. Therefore, it does not mean a pressing pressure after the pressure applied to the outer peripheral side face 8 is lowered by pressure contacting the cell opening end face with the cradle 4.

Figure 11C:
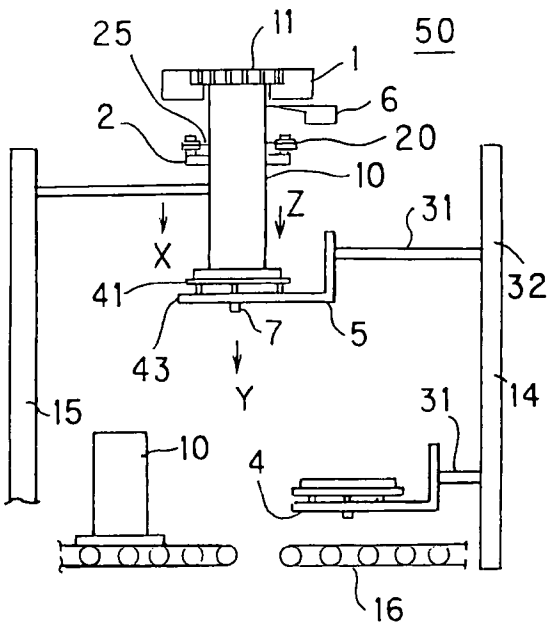
FIG. 11(*a*)-(*c*) show a flow sheet which illustrates a series of the operations in sequence of steps on another embodiment of the present invention.
Figure 11B:
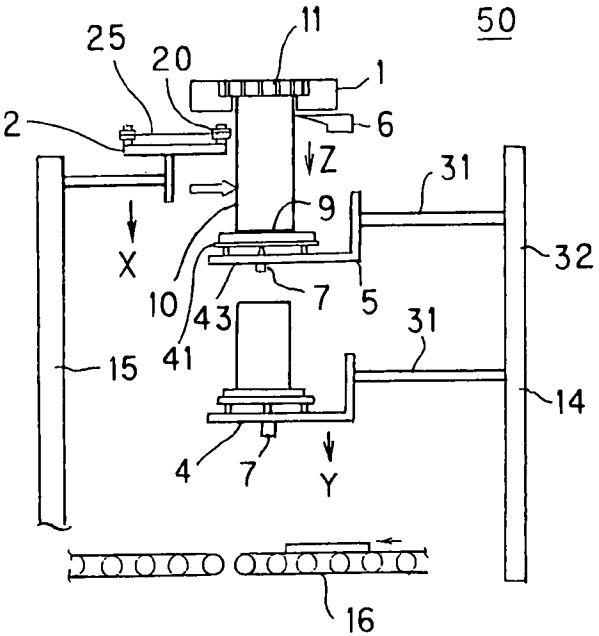
Figure 11A:
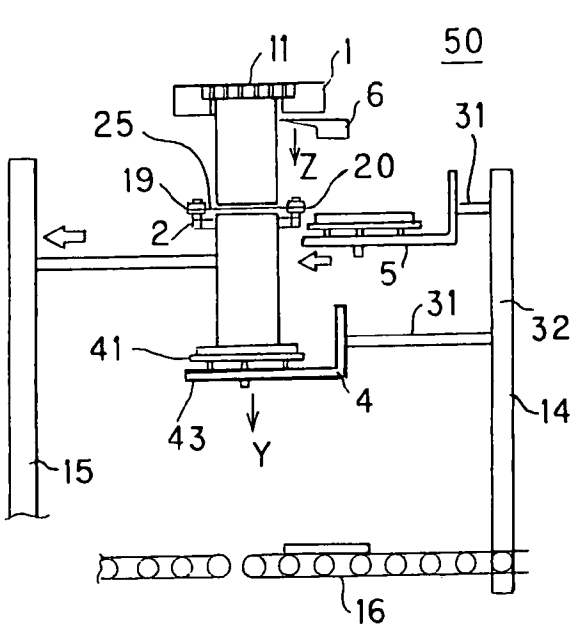

Next, as shown in FIG. 2, the cradle 4 in the present invention may be only one, but in the case of the production apparatus by continuous extrusion, it is preferred that at least two of the cradles 4, 5 are provided and a series of operations for the production of honeycomb structure 10 are independently carried out as shown in FIG. 11(*a*)-(*c*). Specifically, it is preferred that after completion of cutting, one cradle 4 having thereon the cut honeycomb structure 10 is moved by a cradle moving part 14 to the position where the cut honeycomb structure 10 is transferred onto the carrying machine 16, and after transferring the honeycomb structure 10 onto the carrying machine 16, the cradle 4 is on standby at a given position, and on the other hand, another cradle 5 which is waiting at a given position is moved by the cradle moving part 14 to the cell opening end face 9 of the freshly extruded honeycomb structure 10 in parallel with the operations of the cradle 4, and the cradle 5 holds the honeycomb structure 10 in the state of being pressure contacted with the face 9 and then moves in the same direction as the lengthwise direction Z of the honeycomb structure 10 and at a speed at which the pressure contacting state is maintained, and carries out cutting of the honeycomb structure 10 in the pressure contacting state by the cutting device 2, and thereafter the cradle 5 carries out the same motion as of the cradle 4.

In the apparatus 50 provided with these cradles 4, 5, the honeycomb structure 10 can be molded with being placed on the cradles 4, 5 just after starting of the extrusion, and, besides, since the transfer of the honeycomb structure after cutting and movement to the freshly extruded honeycomb structure 10 can be carried out in parallel, the desired molding can be carried out in the apparatus which carries out the extrusion molding at high speed.

Next, the cradle moving part 14 in the present invention may be one which can allow the cradle 4 to make the above mentioned desired motions, and, as shown in FIG. 1, as an example thereof, mention may be made of one which has an arm member 31 which is connected to the cradle 4 and has such structure as capable of being extended and contracted in a direction perpendicular to the extrusion direction Z of the honeycomb structure 10 and a lifting member 32 which moves up and down the arm member 31 in the extrusion direction of the honeycomb structure 10. The cradle moving part 14 may be one having usually employed mechanism, and, as examples thereof, mention may be made of various mechanisms such as air cylinder type, hydraulic type and belt type.

The controlling means of the cradle moving part 14 can also be one which allows the cradle 4 to make the desired motions, and, for example, may be one which moves the cradle 4 by driving the cradle moving part 14 in accordance with the instructions from a controlling part (not shown) on the basis of a time schedule relating to the operation of the cradle 4 which is set in the controlling part.

In order to carry out the control more precisely, such as moving of the cradle in correspondence with change of extrusion speed in lengthwise direction of honeycomb structure 10, it is preferred to sense the necessary information in real time by various sensors and to drive the cradle moving part based on the information.

As to the sensors, mention may be made of a sensor which can sense the time at which the honeycomb structure 10 is placed on the cradle 4 as a sensor for starting the movement of a cradle 2 in lengthwise direction Z of the honeycomb structure at the time of placing the honeycomb structure 10, and a sensor which can sense the information necessary for movement such as extrusion speed in lengthwise direction of the honeycomb structure 10 as a sensor for moving the cradle 4 at nearly the same speed as the extrusion speed in the lengthwise direction of the honeycomb structure 10 after starting of movement of the cradle 4 in the direction Z. Furthermore, mention may be made of one which can sense completion of the cutting in order to start the movement of the cradle 4 to the transferring position after completion of cutting and the movement of the cradle to the cell opening end face 9 of the newly extruded honeycomb structure 10.

In the present invention, as a sensor which senses the time at which the honeycomb structure 10 is placed, there may be mentioned a load sensor 7 which senses the change of load caused at the time of placing the honeycomb structure 10 on the cradle 4 as shown in FIG. 2.

Furthermore, as a sensor which senses the information for moving the cradle 4 at a desired speed after starting of movement, in addition to the speed sensor 6 which directly measures the extrusion speed in the lengthwise direction of the honeycomb structure 10, there may be mentioned the load sensor 7 which senses the change of load applied to the cradle 4 which is caused due to the difference between the moving speed of the cradle 4 after starting of the movement and the extrusion speed in the lengthwise direction of the honeycomb structure 10 (FIG. 2 shows an example of carrying out adjustment of speed of the cradle 4 by the speed sensor 6, but the speed adjustment of the cradle 4 may be carried out by the load sensor 7). In the case of the speed sensor 6, the cradle 4 can be moved at the same speed based on the sensed extrusion speed in the lengthwise direction, and in the case of the load sensor 7, the cradle 4 can be moved so that the change of load is within the desired range based on the sensed change of the load. Moreover, when the speed sensor 6 is applied, the time at which the length of the honeycomb structure 10 reaches the desired length can also be sensed by integrating the resulting extrusion speed in lengthwise direction with speed sensing time, and hence the starting of the movement of the cutting device 2 in the direction perpendicular to the lengthwise direction Z mentioned hereinafter can also be controlled by the same sensor.

Furthermore, as sensors which sense completion of cutting, mention may be made of one which senses completion of movement of the cutting device 2 in the direction perpendicular to the lengthwise direction Z of the honeycomb structure, one which senses completion of cutting by the change of torque of the driving part in the cutting device where the cutting small-gage wire is connected to the driving part, and the like. However, from the point that erroneous sensing caused by deflection or breakage of the small-gage wire for cutting can be avoided, preferred is the load sensor 7, more specifically, one which indirectly senses the abrupt changes of load applied to the cradle 4 caused at the time of completion of cutting of the honeycomb structure 10 by spring displacement, inner pressure displacement such as air cylinder or air cushion, or bending displacement of piezoelectric element.

As is clear from the above, according to the load sensor 7, information which is necessary for controlling the movement of cradle 4 can be sensed by one sensor and the similar control can also be performed for the cutting device 2. Moreover, as mentioned hereinafter, since sensing of completion of cutting is possible, starting of movement of the cradle 4 and the like after completion of cutting can be controlled. However, if a speed sensor 6 is used, the cradle 4 can be moved responding more rapidly to the increase in length of the honeycomb structure 10, and hence it is also preferred to use the load sensor 7 and the speed sensor 6 in combination.

In the present invention, the speed sensor 6 may be those which are based on any principle, but from the points that the limitation in setting position is less and that the sensing speed is high and the cradle 4 can be moved responding rapidly to the extrusion speed in lengthwise direction of the honeycomb structure 10, preferred are those which can sense the extrusion speed in lengthwise direction of the honeycomb structure 10 in non-contact state by utilizing laser beams or ultrasonic waves.

Furthermore, the load sensor 7 may be those which are based on any principle, and mention may be made of, for example, those which sense the load applied to the cradle 4 utilizing displacements of various elastic bodies, such as spring displacement, inner pressure displacement, bending displacement of piezoelectric element, and the like.

Moreover, as shown in FIGS. 6–9, in the case of sensing the load applied to the cradle 4 utilizing the displacement of an elastic body 40, it is preferred to use the cradle 4 composed of a main body 43 connected to the cradle moving part 14, a placing part 41 movably provided on the main body 43, and an elastic body 40 such as a spring 42 and to provide the load sensor 7 which senses the load applied to the placing part 41 by the displacement of the elastic body 40.

Figure 10:
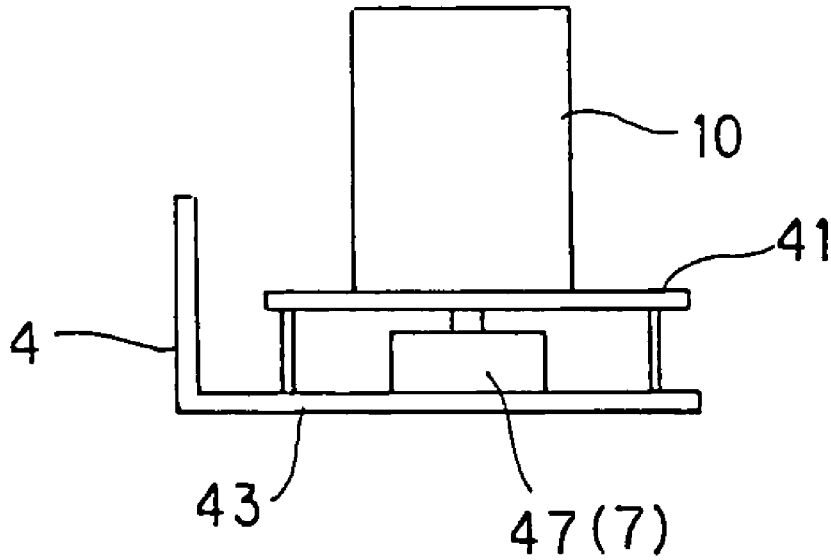
FIG. 10 is a schematic view which shows another example of the cradle and the load sensor in the present invention.

Similarly, as shown in FIG. 10, in the case of sensing the load applied to the cradle 4 utilizing the bending displacement of piezoelectric body, it is preferred that the cradle 4 is constituted of the main body 43 connected to the cradle moving part 14 and the placing part 41 movably provided on the main body 43, and the load sensor 7 which senses the load applied to the placing part 41 by the bending displacement of the piezoelectric body is provided.

In the case of such a construction as sensing the load applied to the placing part 41 utilizing the displacement of various elastic bodies 40 as shown in FIGS. 6–9, breakage and the like of the honeycomb structure 10 when it is placed on the cradle 4 can be markedly diminished by the cushioning action of the elastic body in addition to exhibiting the function as the load sensor 7. Further, even when there occurs some slippage of the movement of the cradle 4 with respect to the extrusion speed in lengthwise direction of the honeycomb structure 10, a proper pressure contacting state with the honeycomb structure 10 can be maintained.

Figure 6:
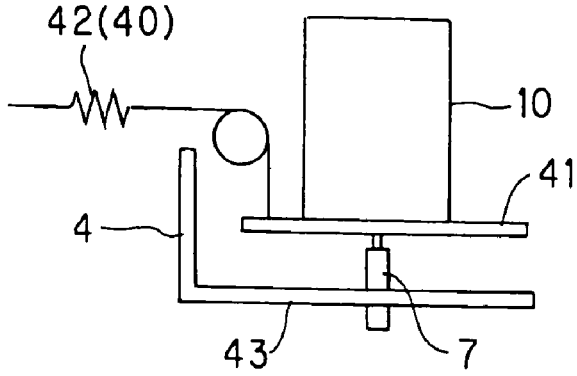
FIG. 6 is a schematic view which shows one example of the cradle and the load sensor in the present invention.
Figure 7:
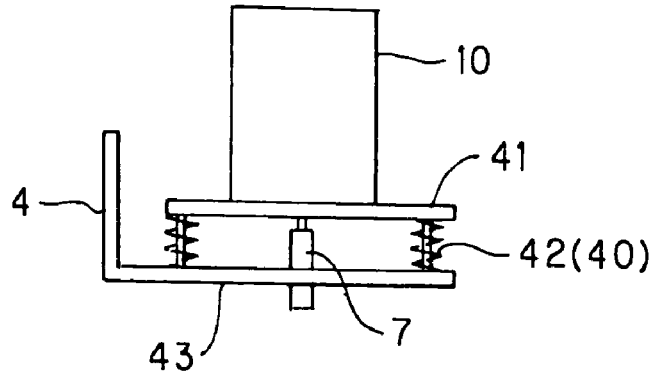
FIG. 7 is a schematic view which shows another example of the cradle and the load sensor in the present invention.

In the present invention, as examples of utilizing the displacement of the elastic body 40, mention may be made of one in which the cradle 4 is constituted of the main body 43 connected to the cradle moving part 14, the placing part 41 provided on the main body 43 in movable state in the extrusion direction and the spring 42 pulling the placing part 41 in the direction opposite to the lengthwise direction of the honeycomb structure 10 by a given force, and the load sensor 7 is constituted of a sensor which senses the displacement of elongation of the spring 42 caused when the extended honeycomb structure 10 presses the placing part 41, as shown in FIG. 6, and one in which the cradle 4 is constituted of the main body 43 connected to the cradle moving part, the placing part 41 provided on the main body 43 in movable state and the spring 42 provided between the main body 43 and the placing part 41, and the load sensor 7 is constituted of a sensor which senses the displacement of elongation of the spring 42 caused when the extended honeycomb structure 10 presses the placing part 41, as shown in FIG. 7.

The former sensor is preferred for sensing the small change of load since it utilizes displacement of elongation of the spring, and the latter sensor is preferred in the case of a large load being applied since it utilizes displacement of contraction of the spring.

Figure 8:
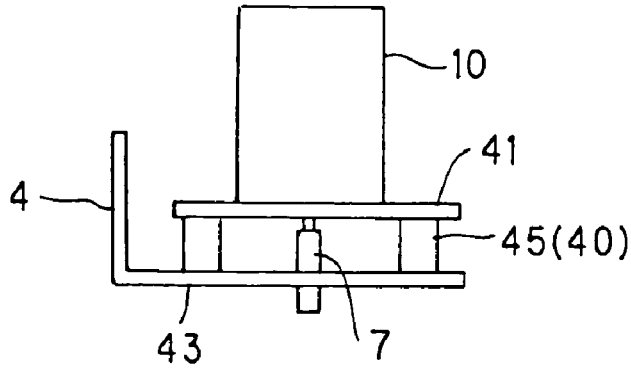
FIG. 8 is a schematic view which shows one example of the cradle and the load sensor in the present invention.
Figure 9:
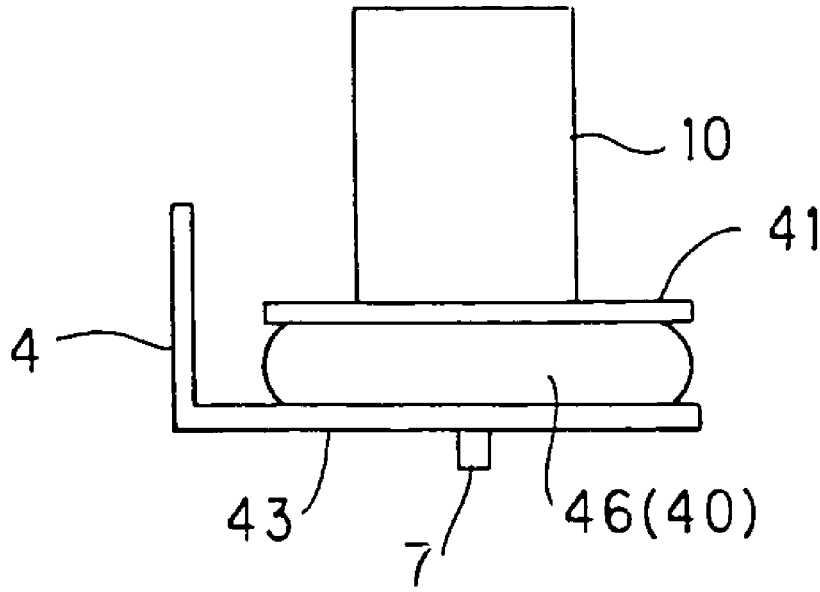
FIG. 9 is a schematic view which shows another example of the cradle and the load sensor in the present invention.

Another example is one in which the cradle 4 is provided with an air cylinder 45 in place of the spring between the placing part 41 and the main body 43, and the load sensor 7 comprises a sensor which senses the displacement of inner pressure of the air cylinder 45 caused when the extended honeycomb structure 10 presses the placing part 41, as shown in FIG. 8, or one in which the cradle 4 is provided with an air cushion 46 in place of the spring between the placing part 41 and the main body 43, and the load sensor 7 comprises a sensor which senses the displacement of inner pressure of the air cushion 46 caused when the extended honeycomb structure 10 presses the placing part 41, as shown in FIG. 9.

According to the example of providing air cylinder 45, since the cylinder pressure can be easily changed, not only honeycomb structures 10 of different weight can be produced by one apparatus, but also honeycomb structures 10 of different weight can be continuously produced by automatically controlling the change of cylinder pressure depending on the weight of the extruded honeycomb structures 10.

Furthermore, in all of the examples, the face pressure of the placing part 41 can be set non-linearly with regard to the displacement of the cylinder pressure, and the honeycomb structure 10 can be softly contacted with the placing part 41 when the honeycomb structure 10 is placed on the cradle 4, whereby breakage such as chipping can be inhibited.

As an example of utilizing the displacement of a piezoelectric body, mention may be made of one in which the cradle 4 is constituted of the main body 43 connected to the cradle moving part and the placing part 41 provided on the main body 43 in movable state, and the load sensor 7 is constituted of a load cell 47 provided between the main body 43 and the placing part 41 as shown in FIG. 10, and such construction is preferred in the case of a large load being applied.

In the present invention, it is preferred to provide a controlling part (not shown) which controls the operation of the cradle moving part 14 based on the information coming from the sensors 6 and 7, but the controlling part may not necessarily be provided inside, and may be provided outside.

Next, in the present invention, the cutting device may not necessarily be provided, but it is preferred to provide the cutting device 2 at the apparatus 50 as shown in FIG. 2, etc. in order to carry out all the steps not manually.

Furthermore, in case the extrusion of the honeycomb structure 10 is continuously carried out without interruption, it is preferred that in the apparatus, the honeycomb structure 10 is cut by moving the cutting device 2 in also the horizontal direction while moving the cutting device 2 in the same direction as the lengthwise direction Z of the honeycomb structure 10 and at the same speed as the extrusion speed in the lengthwise direction.

By allowing the cutting device 2 to make the above motion, the continuously extruded honeycomb structure 10 can be cut desirably, for example, in the direction perpendicular to the lengthwise direction Z.

The cutting device moving part 15 may be one which can make the cutting device 2 to do the desired motion, and as examples, mention may be made of one which has the first arm part 34 connected to the cutting device 2 and extendible and contractible in the direction perpendicular to the lengthwise direction Z of the honeycomb structure 10 (in the drawing, it extends from the innermost side to this side to operate the cutting device), the second arm part 33 which is connected to the first arm part and is extendible and contractible in the direction perpendicular to the lengthwise direction Z of the honeycomb structure 10 and also in the direction perpendicular to the extending and contracting direction of the first arm part 34, and a lifting part 37 connected to the second arm part 33 and moves up and down in the lengthwise direction of the honeycomb structure 10 as shown in FIG. 1. In this case, by using the lifting part 37 in common with the lifting part 32 of the cradle moving part 14 mentioned above, the up and down movement of the cutting device 2 in the lengthwise direction of the honeycomb structure 10 may be interlocked with the up and down movement of the cradle 4.

Further, the cutting device moving part 15 may be of various moving mechanisms such as air cylinder type, hydraulic type and belt type.

The means for controlling the cutting device 2 may be one according to which the cutting device 2 is desirably operated by driving the cradle moving part 14 in accordance with the instructions sent from the control part (not shown) based on the information on extrusion speed in lengthwise direction, length, outer diameter and outer shape of the honeycomb structure 10 which is previously input to the control part. However, preferably, the load applied to the cradle 3 when the extended honeycomb structure 10 is placed on the cradle 4 is sensed by the above-mentioned load sensor 6, and, on the basis of the sensed information, the lifting part 37 is driven to start the movement of the cutting device 2 in the lengthwise direction Z of the honeycomb structure 10. Furthermore, preferably, the extrusion speed in lengthwise direction of the honeycomb structure 10 is sensed by the above-mentioned speed sensor 6 and others, and on the basis of the sensed information and the information of the time lapsing from the starting of the extrusion, the moving speed of the lifting part 37 and the starting time point of the movement of the first and second arm parts 34, 33 are controlled. Moreover, it is also possible to provide at the frame body 20 a sensor (not shown) which senses the distance from the honeycomb structure 10 and allow the cutting device 2 to carry out desired cutting operation while sensing the distance from the honeycomb structure 10.

In this case, it is preferred to provide at the apparatus a control part (not shown) which controls operation of each member of the cutting device moving part 15 on the basis of the information from the sensors 6, 7 and others, but the control part may not necessarily be provided at the apparatus, and the control can be performed by the same control part as of the cradle moving part 14.

Figure 12:
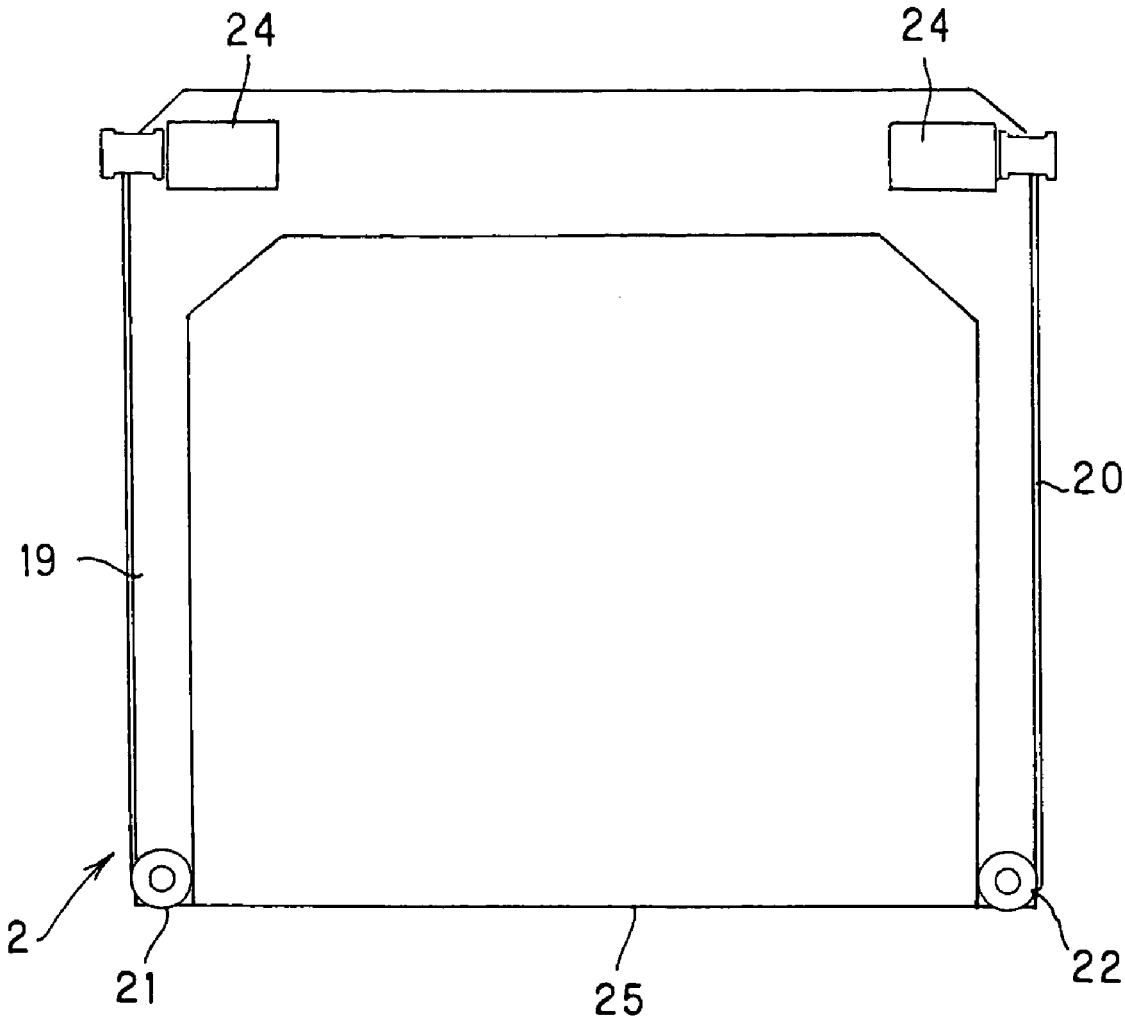
FIG. 12 is a schematic view which shows one example of the cutting device in the present invention.

Next, as shown in FIG. 12, the cutting device 2 in the present invention may be one which has at least two arm members 19, 20 and a cutting small-gage wire 25 stretched between the arm members 19, 20. Usually, two arm members 19, 20 are sufficient, but more arm members 19, 20 may be provided.

Moreover, as the cutting device 2 in the present invention, mention may be made of one in which the cutting small-gage wire 25 is stretched between the arm members 19, 20 in fixed state or both ends of the cutting small-gage wire 25 are connected to the driving part 24 and the cutting small-gage wire 25 is moved in the stretching direction thereof. In the case of the latter cutting device 2, cutting force is increased by the cutting accompanied by movement in the stretching direction of the cutting small-gage wire 25, and, furthermore, since cutting is carried out using always different portions of the cutting small-gage wire 25, the life of very small-gage wire 25 can be much prolonged.

The cutting device 2 is preferably one in which a rotating member 22 is fitted at the tip of each of the arm members 19, 20, the cutting small-gage wire 25 is stretched between the rotating members 22, both ends of the cutting small-gage wire 25 are connected to the driving part 24, and each end of the cutting small-gage wire 25 is pulled by the driving part 24 to move the cutting small-gage wire 25 stretched between the rotating members 22 in the stretching direction.

In the cutting device 2, the cutting small-gage wire 25 stretched between the rotating members 21, 22 may be reciprocated in its stretching direction by alternately pulling the end portions of the cutting small-gage wire 25 by the driving part 24, or the cutting small-gage wire 25 stretched between the rotating members 21, 22 may be moved in only one direction of the stretching direction by pulling one end portion of the cutting small-gage wire 25 by the driving part 24.

Furthermore, as shown in FIG. 2, in the cutting device 2 which carries out cutting by the cutting small-gage wire 25, the cutting small-gage wire 25 is usually provided being stretched in the direction perpendicular to the lengthwise direction Z of the honeycomb structure 10 in order to be able to cut the honeycomb structure 10 in the direction perpendicular to its axial direction. However, when the honeycomb structure 10 is cut in the direction oblique to its axial direction, the cutting small-gage wire 25 may be provided being stretched in the direction oblique to the lengthwise direction of the honeycomb structure 10 (not shown).

The cutting small-gage wire 25 is of materials capable of cutting the honeycomb structure 10, and, furthermore, preferably has a diameter of as small as possible so as not to apply a large force to the honeycomb structure 10 in the diameter direction. Specifically, the wire is preferably made of steel and has a diameter of about 0.1–0.05 mm.

The apparatus for producing honeycomb structures of the present invention is mainly explained above, and by using the apparatus, the method for producing honeycomb structures of the present invention can be carried out. The materials of the honeycomb structures are not particularly limited, and any materials applicable to honeycomb structures, such as cordierite, SiC and alumina, may be used. Further, the present invention is not limited to the embodiment explained above and includes other embodiments as far as the characteristics are not damaged.

INDUSTRIAL APPLICABILITY

According to the present invention, there can be provided an apparatus for producing honeycomb structures which can produce thin-walled or large-sized honeycomb structures without causing distortion of outer wall and cell walls, and a method for producing the honeycomb structures.

The invention claimed is:

1. An apparatus for producing a honeycomb structure provided with an extruder capable of extruding a honeycomb structure in the gravity direction or a direction oblique at an angle of smaller than 30° with the gravity direction and at least one cradle, said apparatus being provided with a means to be able to place the honeycomb structure extending in length with progress of extrusion on the cradle with pressure contacting a cell opening end face of the honeycomb structure with the cradle under a pressure smaller than the compressive strength at the end face and then move the cradle at a speed capable of keeping the pressure contacting state and in the same direction as the lengthwise direction of the honeycomb structure, the pressure being determined by a load sensor which senses a load applied to the cradle.

2. The apparatus for producing a honeycomb structure according to claim 1 which is further provided with a cutting device, said cutting device being provided with a means to be able to cut the honeycomb structure in the state of being pressure contacted with the cradle.

3. The apparatus for producing a honeycomb structure according to claim 1 which is provided with at least two cradles and a cutting device, and has a means of placing the honeycomb structure on one of at least two cradles with pressure contacting the cell opening end face of the honeycomb structure with the cradle under a pressure smaller than the compressive strength at the end face, then moving this cradle in the same direction as the lengthwise direction of the honeycomb structure and at a speed capable of keeping the pressure contacting state, cutting the honeycomb structure in the pressure contacting state by the cutting device, moving this cradle to a position at which the honeycomb structure is transferred, transferring the honeycomb structure after completion of cutting, allowing the cradle to be on standby at a given position, moving another cradle from a given standby position to the cell opening end face of the honeycomb structure freshly extruded in parallel with the motion of the former cradle, and repeating the same motion as of the former cradle.

4. The apparatus for producing a honeycomb structure according to claim 2 which is provided with at least two cradles and a cutting device, and has a means of placing the honeycomb structure on one of at least two cradles with pressure contacting the cell opening end face of the honeycomb structure with the cradle under a pressure smaller than the compressive strength at the end face, then moving this cradle in the same direction as the lengthwise direction of the honeycomb structure and at a speed capable of keeping the pressure contacting state, cutting the honeycomb structure in the pressure contacting state by the cutting device, moving this cradle to a position at which the honeycomb structure is transferred, transferring the honeycomb structure after completion of cutting, allowing the cradle to be on standby at a given position, moving another cradle from a given standby position to the cell opening end face of the honeycomb structure freshly extruded in parallel with the motion of the former cradle, and repeating the same motion as of the former cradle.

5. The apparatus for producing a honeycomb structure according to claim 2, wherein the cutting device is moved in horizontal direction while moving in the same direction as the lengthwise direction of the honeycomb structure and at the same speed as the extrusion speed in the lengthwise direction, thereby cutting the honeycomb structure.

6. The apparatus for producing a honeycomb structure according to claim 4, wherein the cutting device is moved in horizontal direction while moving in the same direction as the lengthwise direction of the honeycomb structure and at the same speed as the extrusion speed in the lengthwise direction, thereby cutting the honeycomb structure.

7. The apparatus for producing a honeycomb structure according to claim 2, wherein the cutting device comprises at least two arm members, a rotating member fitted at the tip of each arm member, a cutting small-gage wire stretched between the rotating members, and a driving part to which both ends of the cutting small-gage wire are connected.

8. The apparatus for producing a honeycomb structure according to claim 6, wherein the cutting device comprises at least two arm members, a rotating member fitted at the tip of each arm member, a cutting small-gage wire stretched between the rotating members, and a driving part to which both ends of the cutting small-gage wire are connected.

9. The apparatus for producing a honeycomb structure according to claim 1 which is further provided with a speed sensor which senses the extrusion speed of the honeycomb structure in the lengthwise direction.

10. The apparatus for producing a honeycomb structure according to claim 9, wherein the speed sensor senses the extrusion speed in the lengthwise direction in non-contact state with the honeycomb structure.

11. The apparatus for producing a honeycomb structure according to claim 1, wherein the cradle is provided with a main body connected to the cradle moving part, a placing part provided on the main body in movable state, and an elastic body which produces a displacement by a load applied to the placing part, said apparatus being provided with the load sensor sensing the load applied to the placing part by a displacement of the elastic body.

12. The apparatus for producing a honeycomb structure according to claim 1, wherein the cradle is provided with a main body connected to the cradle moving part and a placing part provided on the main body in movable state, said apparatus being provided with the load sensor sensing the load applied to the placing part by a bending displacement of a piezoelectric body.

13. The apparatus for producing a honeycomb structure according to claim 9 which is provided with a means of sensing by the load sensor a change of load applied to the cradle when the extended honeycomb structure presses the cradle and starting the movement of the cradle and/or the cutting device in the lengthwise direction of the honeycomb structure on the basis of the information sensed by the load sensor.

14. The apparatus for producing a honeycomb structure according to claim 9 which is provided with a means of sensing the extrusion speed of the honeycomb structure in the lengthwise direction by the speed sensor and moving the cradle after starting the movement at nearly the same speed as the extrusion speed of the honeycomb structure in the lengthwise direction on the basis of the sensed information.

15. The apparatus for producing a honeycomb structure according to claim 1 which is provided with a means of sensing by the load sensor a change of load applied to the cradle which is caused due to the difference between the moving speed of the cradle after starting of the movement and the extrusion speed of the honeycomb structure in the lengthwise direction, and adjusting the cradle so that the change of the load is within a desired range on the basis of the sensed information.

16. The apparatus for producing a honeycomb structure according to claim 9 which is provided with a means of sensing the extrusion speed of the honeycomb structure in the lengthwise direction by the speed sensor, and moving, on the basis of the sensed information, the cutting device in horizontal direction while moving it in the same direction as the lengthwise direction of the honeycomb structure and at the same speed as the extrusion speed in the lengthwise direction, thereby cutting the honeycomb structure.

17. The apparatus for producing a honeycomb structure according to claim 1 which is provided with a means of sensing by the load sensor a change of load applied at the time of completion of cutting of the honeycomb structure and starting the movement of the cradle to the transfer position and/or to the cell opening end face of the freshly extruded honeycomb structure on the basis of the sensed information.

18. A method for producing a honeycomb structure, characterized by extruding a material mainly composed of ceramics by an extruder in the gravity direction or a direction oblique at an angle of smaller than 30° with the gravity direction to form a honeycomb structure having a plurality of cells opening at an end face, molding the extruded honeycomb structure with pressure contacting the cell opening end face of the honeycomb structure with the cradle under a pressure smaller than the compressive strength at the end face, and cutting the honeycomb structure in the state of being pressure contacted with the cradle, the pressure being determined by a load sensor which senses a load applied to the cradle.

19. The method for producing a honeycomb structure according to claim 18, wherein the honeycomb structure is cut while moving the cutting device in the same direction as the lengthwise direction of the honeycomb structure and at the same speed as the extrusion speed in the lengthwise direction.

20. The apparatus for producing a honeycomb structure according to claim 1, wherein the pressure is in a range of 10 to 80% of the compressive strength of the end surface.

* * * * *